US007688292B2

(12) United States Patent
Park et al.

(10) Patent No.: US 7,688,292 B2
(45) Date of Patent: Mar. 30, 2010

(54) ORGANIC LIGHT EMITTING DIODE DISPLAY DEVICE AND DRIVING METHOD THEREOF

(75) Inventors: Kee-Chan Park, Gyeonggi-do (KR); Ho-Suk Maeng, Seoul (KR); Seong-Il Park, Seoul (KR); Cheol-Min Kim, Seoul (KR); Chi-Woo Kim, Seoul (KR); Soong-Yong Joo, Gyeonggi-do (KR); Il-Gon Kim, Seoul (KR)

(73) Assignee: Samsung Electronics Co., Ltd. (KR)

( * ) Notice: Subject to any disclaimer, the term of this patent is extended or adjusted under 35 U.S.C. 154(b) by 1004 days.

(21) Appl. No.: 11/373,671

(22) Filed: Mar. 9, 2006

(65) Prior Publication Data

US 2006/0221662 A1 Oct. 5, 2006

(30) Foreign Application Priority Data

Mar. 16, 2005 (KR) ..... 10-2005-0021944

(51) Int. Cl.
*G09G 3/32* (2006.01)

(52) U.S. Cl. ..... 345/82

(58) Field of Classification Search ..... 345/82, 345/205, 206

See application file for complete search history.

(56) References Cited

U.S. PATENT DOCUMENTS 6,307,622 B1 10/2001 Lewis
6,753,655 B2 6/2004 Chen et al.
7,187,004 B2 * 3/2007 Miyazawa ..... 257/59
2002/0000576 A1 * 1/2002 Inukai ..... 257/202
2004/0046719 A1 3/2004 Wang et al.
2004/0113874 A1 * 6/2004 Kasai ..... 345/76
2004/0145547 A1 * 7/2004 Oh ..... 345/76
2004/0252085 A1 * 12/2004 Miyagawa ..... 345/76
2004/0263741 A1 * 12/2004 Koyama et al. ..... 349/139
2005/0017934 A1 * 1/2005 Chung et al. ..... 345/82
2005/0156829 A1 * 7/2005 Choi et al. ..... 345/76
2005/0243033 A1 * 11/2005 Kim et al. ..... 345/76
2006/0066532 A1 * 3/2006 Jeong ..... 345/76
2006/0221005 A1 * 10/2006 Omata et al. ..... 345/76

FOREIGN PATENT DOCUMENTS

CN 1517965 A 8/2004

(Continued)

*Primary Examiner*—Richard Hjerpe
*Assistant Examiner*—Andrew Schnirel
(74) *Attorney, Agent, or Firm*—Cantor Colburn LLP

(57) ABSTRACT

A display device includes a plurality of pixels, wherein each pixel includes: a light emitting element; a first capacitor connected between a first node and a second node; a driving transistor having an input terminal, an output terminal, and a control terminal connected to the second node where the driving transistor supplies a driving current to the light emitting element to emit light; a first switching unit supplying a first reference voltage to the driving transistor according to a first scanning signal and connecting the first node to a data voltage or the driving transistor; and a second switching unit supplying a driving voltage to the driving transistor according to a second scanning signal and connecting the first node to the data voltage. Accordingly, variations in threshold voltage of the driving transistor can be compensated for so that it is possible to display a uniform image.

26 Claims, 13 Drawing Sheets

FOREIGN PATENT DOCUMENTS

| | | |
|---|---|---|
| JP | 2001-147659 | 5/2001 |
| JP | 2003-108067 | 4/2003 |
| JP | 2003-255856 | 9/2003 |
| JP | 2004-078163 | 3/2004 |
| JP | 2004-246204 | 9/2004 |
| JP | 2004-280059 | 10/2004 |
| JP | 2004-354427 | 12/2004 |
| KR | 2002-0056353 | 7/2002 |
| KR | 2003-0073116 | 9/2003 |
| KR | 2003-0081919 | 10/2003 |
| KR | 2004-0008922 | 1/2004 |
| KR | 2004-0009285 | 1/2004 |
| KR | 2004-0009573 | 1/2004 |
| KR | 2004-0033679 | 4/2004 |
| KR | 2004-0085654 | 10/2004 |
| KR | 2004-0093785 | 11/2004 |

* cited by examiner

ORGANIC LIGHT EMITTING DIODE DISPLAY DEVICE AND DRIVING METHOD THEREOF

BACKGROUND OF THE INVENTION (a) Field of the Invention

The present invention relates to a display device and a driving method thereof, and more particularly, to an organic light emitting diode display and a driving method thereof.

(b) Description of Related Art

In general, in active type flat display devices, a plurality of pixels are arrayed in a matrix, and intensity of light of the pixels is controlled according to given brightness information so that an image is displayed. The organic light emitting diode (OLED) display is a display device which electrically excites phosphorous organic materials to display an image. As a self-emitting display device with low power consumption, a wide viewing angle, and a high response speed, the OLED display can easily display a high quality moving image.

The OLED display includes organic light emitting devices (OLEDs) and thin film transistors (TFTs) which drive the OLEDs. The TFTs are classified into polysilicon TFTs and amorphous silicon TFTs according to types of active layers.

Since amorphous silicon can be deposited at a low temperature to form a thin film, the amorphous silicon is mainly used for a semiconductor layer of a switching element of a display device that includes a glass substrate having a low melting point. However, due to low electron mobility of the amorphous silicon TFT, it is difficult to obtain a wide-area display device by using the amorphous silicon TFT. In addition, as a direct current is continuously supplied to a control terminal of the amorphous silicon TFT, a threshold voltage of the TFT may be shifted, so that the TFT may deteriorate. For the reason, the lifetime of the OLED display may be greatly reduced.

Therefore, a polysilicon TFT having high electron mobility, a good high-frequency operating characteristic, and a low leakage current is required. Particularly, a low temperature polysilicon (LTPS) backplane may increase the lifetime of the OLED display. However, marks of laser shots involved in laser crystallization may cause a deviation in the threshold voltage of the driving transistors in one panel, so that screen uniformity may deteriorate.

SUMMARY OF THE INVENTION

The present invention provides an OLED display having polysilicon TFTs that are capable of compensating for a variation in a threshold voltage, and a driving method therefore.

According to an aspect of the present invention, there is provided a display device including a plurality of pixels, wherein each of the pixels includes: a light emitting element; a first capacitor connected between a first node and a second node; a driving transistor having an input terminal, an output terminal coupled to the light emitting element, and a control terminal connected to the second node where the driving transistor supplies a driving current to the light emitting element to emit light; a first switching unit supplying a first reference voltage to the input terminal of the driving transistor according to a first scanning signal and connecting the first node to a data voltage or the driving transistor; and a second switching unit supplying a driving voltage to the input terminal of the driving transistor according to a second scanning signal and connecting the first node to the data voltage.

In the aforementioned aspect of the present invention, the first switching unit may include a first switching transistor connecting the first reference voltage to the control terminal of the driving transistor according to the first scanning signal.

In addition, the first switching unit may include a second transistor connecting the data voltage to the first node according to the first scanning signal, and a third switching transistor connecting the first node to the input terminal of the driving transistor according to the first scanning signal.

The second switching unit may include a fourth transistor connecting the data voltage to the first node according to the second scanning signal, and a fifth switching transistor connecting the driving voltage to the input terminal of the driving transistor according to the second scanning signal.

The first scanning signal may substantially simultaneously turn the first and third switching transistors on and the second switching transistor off, or turn the first and third switching transistors off and the second switching transistor on.

The second scanning signal may substantially simultaneously turn the fourth switching transistor on and the fifth switching transistor off, or turn the fourth switching transistor off and the fifth switching transistor on.

The first to fifth switching transistors and the driving transistor may be made of polysilicon thin film transistors, and the driving transistor may be a p-channel thin film transistor. The first, third, and fourth switching transistors may have a different channel type from that of the second and fifth switching transistors.

The pixel further may include a second capacitor connected between the first node and a second reference voltage, and the second reference voltage may be equal to the driving voltage. The first reference voltage may be equal to the data voltage.

According to another aspect of the present invention, there is provided a display device including: a light emitting element; a first capacitor connected between a first node and a second node; a driving transistor having an input terminal, an output terminal connected to the light emitting element, and a control unit connected to the second node; a first switching transistor operating in response to a first scanning signal and connected between a first reference voltage and the second node; a second switching transistor operating in response to the first scanning signal and connected between a data voltage and the first node; a third switching transistor operating in response to the first scanning signal and connected between the first node and the input terminal of the driving transistor; a fourth switching transistor operating in response to a second scanning signal and connected between the data voltage and the first node; and a fifth switching transistor operating in response to the second scanning signal and connected between a driving voltage and the input terminal of the driving transistor.

In the aforementioned aspect of the present invention, first, second, third, and fourth periods may be sequentially provided. During the first period, the first, third, and fifth switching transistors are turned on and the second and fourth switching transistors are turned off. During the second period, the first and third switching transistors are turned on and the second and fifth switching transistors are turned off. During the third period, the second and fourth switching transistors are turned on and the first, third, and fifth switching transistors are turned off. During the fourth period, the fifth switching transistor is turned on and the first, third, and fourth switching transistors are turned off.

According to another aspect of the present invention, there is provided a method of driving a display device including a light emitting element, a first capacitor connected between a first node and a second node, a second capacitor connected to the first node, and a driving transistor having an input terminal, an output terminal, and a control terminal connected to the second node, the method including: applying a first reference voltage to the second node; applying a driving voltage to the first node; discharging a voltage stored in the first capacitor; applying a data voltage to the first node; and applying the driving voltage to the input terminal of the driving transistor.

In the aforementioned aspect of the present invention, the application of the driving voltage to the first node may include: connecting the first node to the input terminal of the driving transistor.

The discharging may include: disconnecting the first node and the input terminal of the driving transistor from the driving voltage.

The application of the data voltage to the first node may include: floating the input terminal of the driving transistor.

The floating step may include: disconnecting the input terminal of the driving transistor from the first node.

The application of the data voltage to the first node may include: disconnecting the second node from the first reference voltage. The method may further include: applying the driving voltage to the second capacitor.

BRIEF DESCRIPTION OF THE DRAWINGS

The above and other features and advantages of the present invention will become more apparent by describing in detail exemplary embodiments thereof with reference to the attached drawings, in which.

DETAILED DESCRIPTION OF EMBODIMENTS

Figure 1:
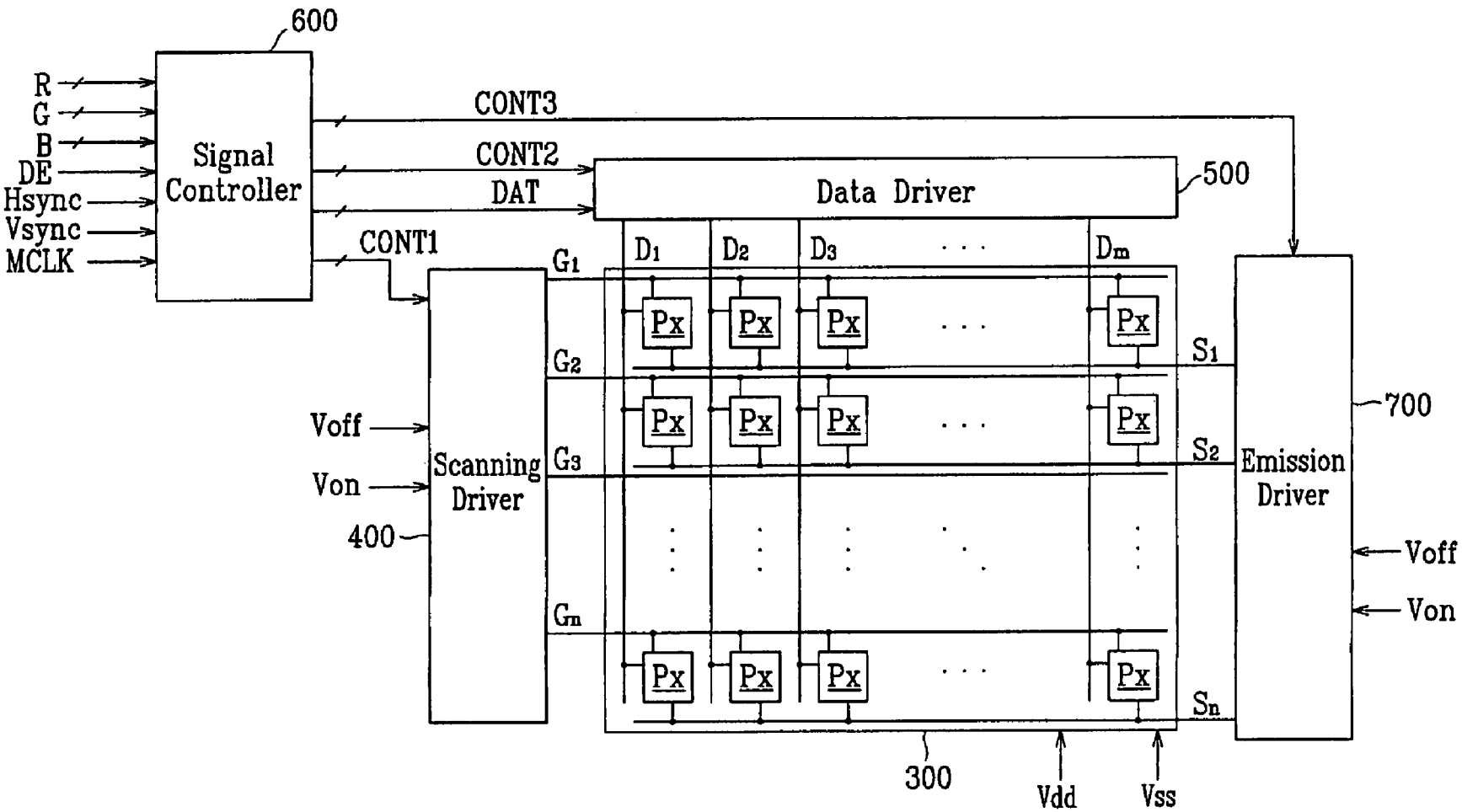
FIG. 1 is a block diagram showing an OLED display according to an embodiment of the present invention.

Hereinafter, exemplary embodiments of the present invention will be described in detail with reference to the attached drawings such that the present invention can be easily put into practice by those skilled in the art.

In the drawings, thicknesses are enlarged for the purpose of clearly illustrating layers and areas. In addition, like elements are denoted by like reference numerals in the whole specification. If it is mentioned that a layer, a film, an area, or a plate is placed on a different element, it includes a case that the layer, film, area, or plate is placed right on the different element, as well as a case that another element is disposed therebetween. On the contrary, if it is mentioned that one element is placed right on another element, it means that no element is disposed therebetween.

First, an OLED display according to an embodiment of the present invention will be described with reference to FIGS. 1 and 2.

Figure 2:
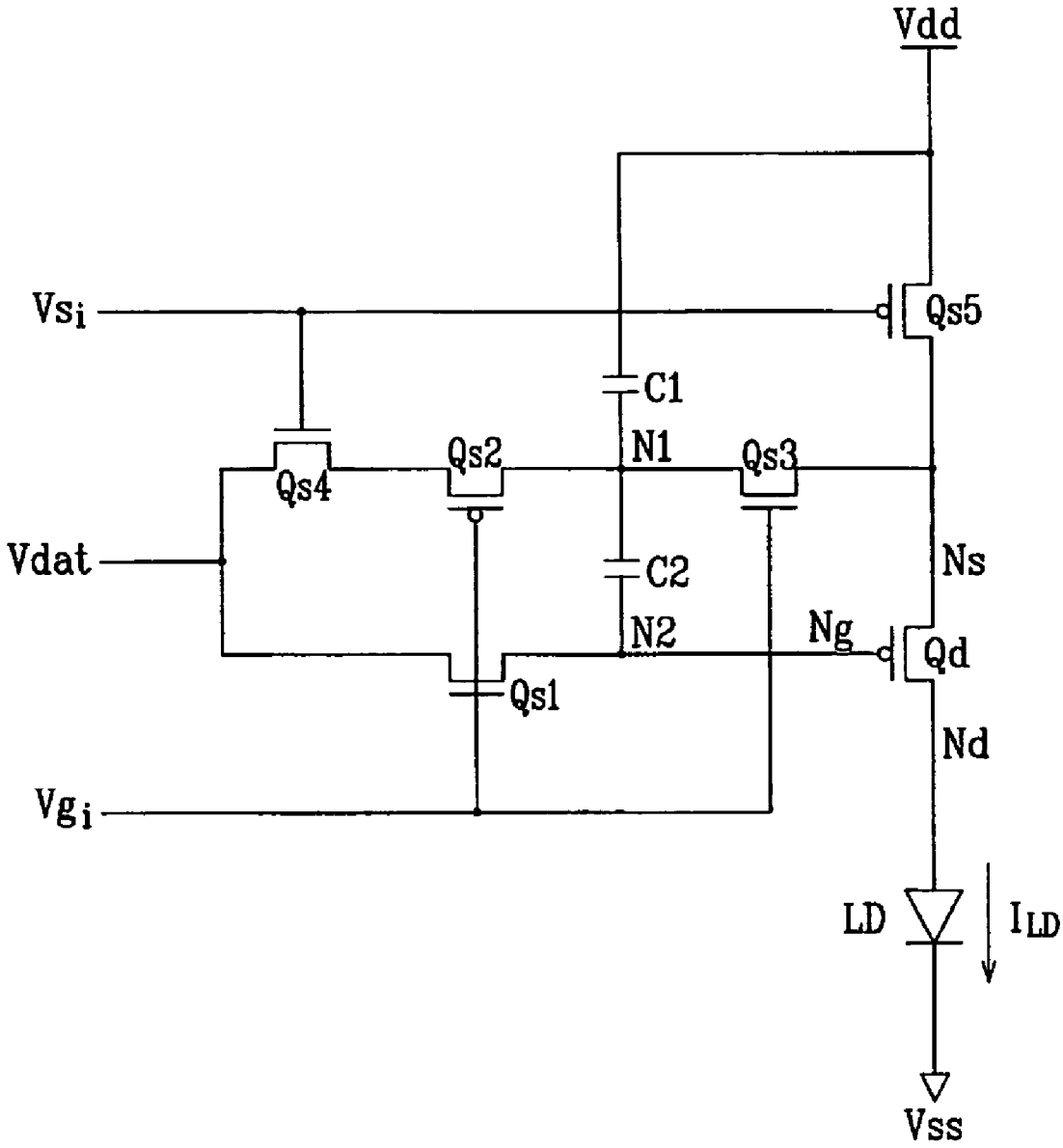
FIG. 2 is an equivalent circuit diagram of a pixel in the OLED display according to the embodiment of the present invention.

FIG. 1 is a block diagram of an OLED display according to the embodiment of the present invention, and FIG. 2 is an equivalent circuit diagram of a pixel of an OLED display according to the embodiment of the present invention.

As shown in FIG. 1, an OLED display according to this embodiment of the present invention includes a display panel 300, a scanning driver 400, a data driver 500, and an emission driver 700 which are connected to the display panel 300, and a signal controller 600 which controls the above-described elements.

Still referring to FIG. 1, the display panel 300 includes a plurality of signal lines $G_1$-$G_n$, $D_1$-$D_m$, and $S_1$-$S_n$, a plurality of voltage lines (not shown), and a plurality of pixels Px which are connected to the signal lines $G_1$-$G_n$, $D_1$-$D_m$, and $S_1$-$S_n$ and arranged substantially in a matrix.

The signal lines $G_1$-$G_n$, $D_1$-$D_m$, and $S_1$-$S_n$ include a plurality of scanning signal lines $G_1$-$G_n$ which transmit scanning signals, a plurality of data lines $D_1$-$D_m$ which transmit data signals, and a plurality of emission signal lines $S_1$-$S_n$ which transmit emission signals. The scanning signal lines $G_1$-$G_n$ and the emission signal lines $S_1$-$S_n$ extend substantially in the row direction and are substantially parallel to each other, and one scanning signal line and one emission signal line are provided for each pixel. The data lines $D_1$-$D_m$ extend substantially in the column direction and are substantially parallel to each other.

The voltage lines include driving voltage lines (not shown) which transmit a driving voltage Vdd.

As shown in the equivalent circuit diagram of FIG. 2, each of the pixels Px includes an organic light emitting element LD such as an organic light emitting diode (OLED), a driving transistor Qd, two capacitors C1 and C2, and five switching transistors Qs1-Qs5.

The driving transistor Qd has an output terminal Nd, an input terminal Ns, and a control terminal Ng. The output terminal Nd is connected to the organic light emitting element LD and the input terminal Ns is connected through switching transistor Qs5 to the driving voltage Vdd. The control terminal Ng is connected to a node N2 to which the capacitor C2 and the switching transistor Qs1 are connected.

The capacitor C1 has one terminal of the capacitor connected to a node N1 to which the capacitor C2 and the switching transistors Qs2 and Qs3 are connected, and the other terminal connected to the driving voltage Vdd. The capacitor C2 is connected between the node N1 and the node N2.

The organic light emitting element LD has an anode connected to the driving transistor Qd and a cathode connected to a common voltage Vss. The organic light emitting element LD emits light with different intensities according to an amount of a current $I_{LD}$ supplied by the driving transistor Qd, so that an image can be displayed. The amount of the current $I_{LD}$ depends on a magnitude of a voltage between the control terminal Ng and the output terminal Nd of the driving transistor Qd.

The switching transistors Qs1-Qs3 operate in response to the scanning signal $Vg_i$.

The switching transistor Qs1 is connected between a data voltage Vdat and the node N2, the switching transistor Qs2 is connected between the switching transistor Qs4 and the node N1, and the switching transistor Qs3 is connected between the node N1 and the input terminal Ns of the driving transistor Qd.

The switching transistors Qs4 and Qs5 operate in response to an emission signal $Vs_i$.

The switching transistor Qs4 is connected between the data voltage Vdat and the switching transistor Qs2, and the switching transistor Qs5 is connected between the driving voltage Vdd and the input terminal Ns of the driving transistor Qd.

The switching transistors Qs1, Qs3, and Qs4 are n-channel polysilicon thin film transistors (TFTs), and the switching transistors Qs2 and Qs5 and the driving transistor Qd are p-channel polysilicon TFTs. However, these transistors may be amorphous silicon TFTs, and the channel types of the transistors Qs1-Qs5 and Qd may be reversed.

Now, the structures of the driving transistor and the organic light emitting diode of the OLED display will be described in detail with reference to FIGS. 3 and 4.

Figure 3:
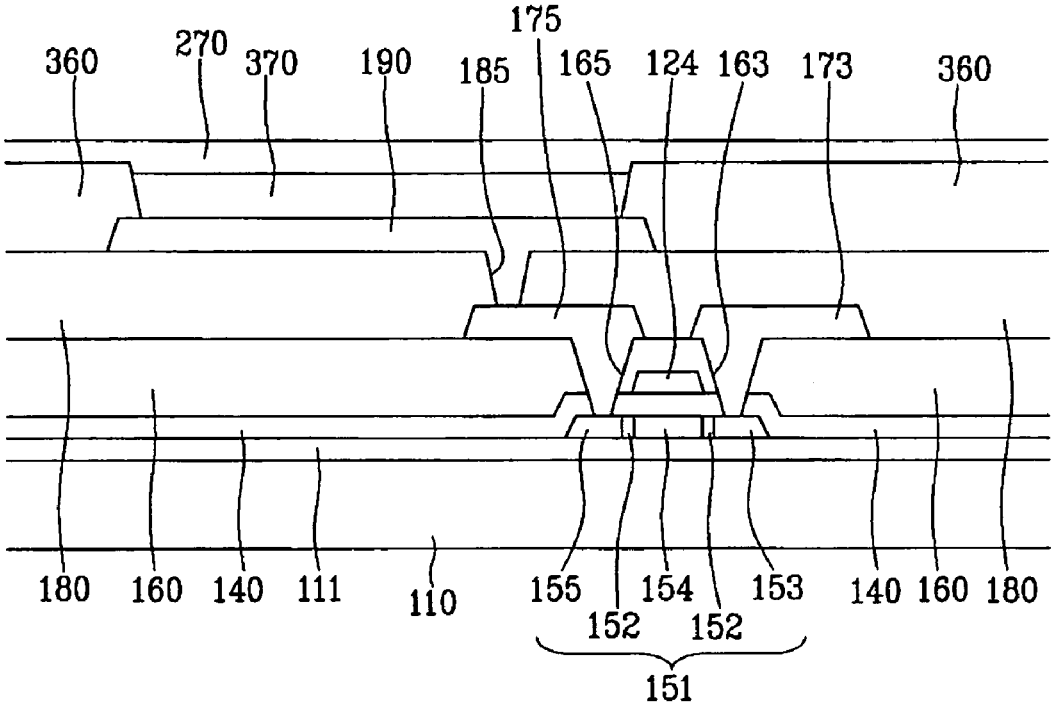
FIG. 3 is a sectional view showing a cross-section of a pixel and an organic light emitting device of the OLED display shown in FIG. 2.
Figure 4:
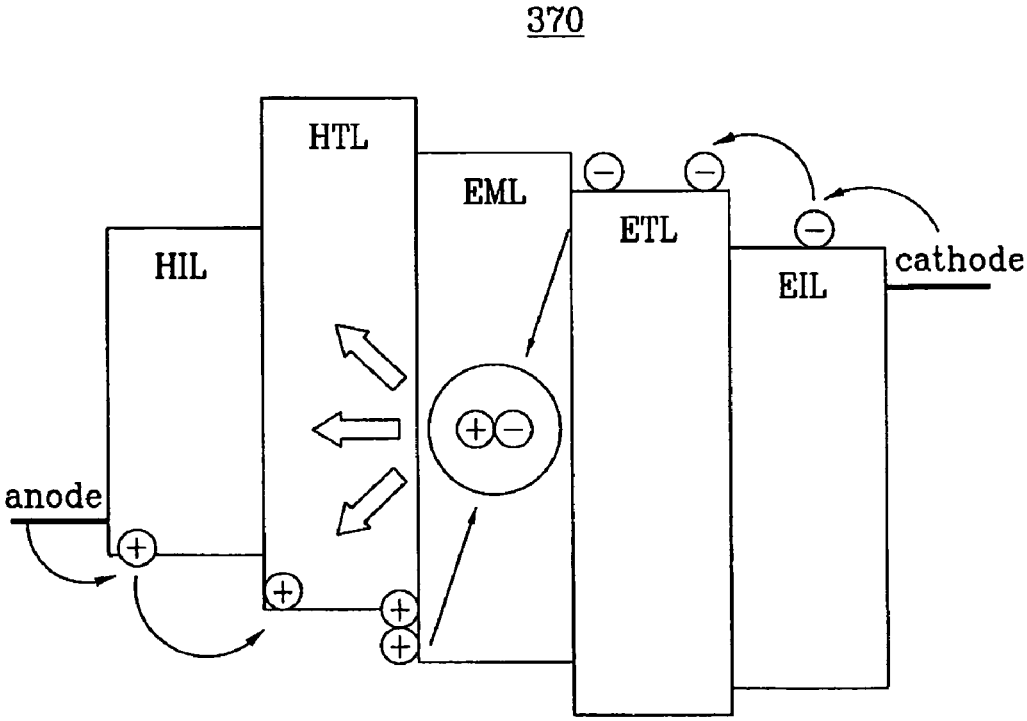
FIG. 4 is a schematic view showing an organic light emitting device of the OLED display according to the embodiment of the present invention.

FIG. 3 is a sectional view of an exemplary driving transistor and an exemplary organic light emitting element of a pixel of the OLED display shown in FIG. 2, and FIG. 4 is a schematic view showing the organic light emitting element of the OLED display according to an embodiment of the present invention.

As shown in FIG. 3, a blocking film 111 is disposed on a transparent dielectric substrate 110. The blocking film 111 may be made of silicon oxide ($SiO_2$), a silicon nitride ($SiN_x$), or the like, and may have a multi-layered structure.

A semiconductor member 151 made of polysilicon is disposed on the blocking film 111.

The semiconductor member 151 includes an extrinsic region that contains conductive impurities, and an intrinsic region that contains almost no conductive impurity. The extrinsic region includes a heavily doped region having a high impurity concentration, and a lightly doped region having a low impurity concentration.

The intrinsic region includes a channel region 154. The heavily doped region includes source and drain regions 153 and 155 which are separated from each other with respect to the channel region 154 interposed therebetween. The lightly doped region 152 includes lightly doped drain (LDD) regions 152 interposed between the source and drain regions 153 and 155 and the channel region 154, and are narrower than other regions.

Here, examples of the conductive impurities may include p-type impurities such as boron (B) and gallium (Ga), or n-type impurities such as phosphorus (P) and arsenic (As). The LDD regions 152 prevent leakage current or a punch-through phenomenon in a TFT. The LDD regions 152 may be replaced with offset regions containing no impurities. In addition, in a p-type TFT, the LDD regions 152 may be omitted.

A gate insulating layer 140 made of silicon oxide ($SiO_x$) or a silicon nitride (SiNx) and having a thickness of several hundred angstroms (Å) is disposed on the semiconductor member 151.

A control electrode 124 overlapping the channel region 154 of the semiconductor member 151 is disposed on the gate insulating layer 140. The control electrode 124 may be made of an aluminum-based metal such as aluminum (Al) and an aluminum alloy, a silver-based metal such as silver (Ag) and a silver alloy, a copper-based metal such as copper (Cu) and a copper alloy, a molybdenum-based metal such as molybdenum (Mo) and a molybdenum alloy, chromium (Cr), titanium (Ti), or tantalum (Ta). However, the control electrode 124 may have a multi-layered structure including two conductive layers (not shown) having different physical properties. One of the two conductive layers is made of a metal having low resistivity, for example, an aluminum-based metal, a silver-based metal, and a copper-based metal, in order to reduce signal delay or voltage drop. The other conductive layer is made of a material having good physical, chemical, and electrical contact characteristics to other materials, particularly to ITO (indium tin oxide) and IZO (indium zinc oxide), such as a molybdenum-based metal, chromium, titanium, and tantalum. As a preferred example of the combination, there are a combination of a lower chromium layer and an upper aluminum (alloy) layer and a combination of a lower aluminum (alloy) layer and an upper molybdenum (alloy) layer. However, the control electrode 124 may be made of various metals and conductive materials. Side surfaces of the control electrode 124 are slanted with respect to a surface of the substrate 110 so that thin films thereon can be smoothly connected thereto.

An interlayer insulating film 160 is formed on the control electrode 124 and the gate insulating layer 140. The interlayer insulating film 160 may be made of an inorganic material such as silicon nitride, an organic material, or a low-dielectric insulating material. The low-dielectric insulating material may include a-Si:C:O or a-Si:O:F which are formed by using a plasma enhanced chemical vapor deposition (PECVD). The material forming the interlayer insulating film 160 may have photosensitivity and the interlayer insulating film 160 may have a flat surface.

Contact holes 163 and 165 that expose the source and drain regions 153 and 155 are formed in the interlayer insulating film 160 and the gate insulating layer 140.

An input electrode 173 and an output electrode 175 are formed on the interlayer insulating film 160.

The input electrode 173 and the output electrode 175 are separated from each other with respect to the control electrode 124 interposed therebetween. The input electrode 173 and the output electrode 175 are connected through the contact holes 163 and 165 to the source and drain regions 153 and 155.

The control electrode 124, the input electrode 173, and the output electrode 175 together with the semiconductor member 151 form a driving transistor Qd.

The input electrode 173 and the output electrode 175 are preferably made of chromium, a molybdenum based metal, or a refractory metal such as tantalum and titanium. In addition, the input electrode 173 and the output electrode 175 may have a multi-layered structure including a lower layer (not shown) made of the refractory metal and an upper layer (not shown) made of a low resistance material disposed on the lower layer. As an example of the multi-layered structure, there are a two-layered structure of a lower chromium or molybdenum (alloy) layer and an upper aluminum layer, and a three-layered structure of a lower molybdenum (alloy) layer, an intermediate aluminum (alloy) layer, and an upper molybdenum (alloy) layer. Side surfaces of the input electrode 173 and the output electrode 175 are also slanted with respect to the surface of the substrate 110.

A protective film (passivation film) 180 is formed on the input electrode 173, the output electrode 175, and the interlayer insulating film 160. The protective film 180 may be made of the same material as that of the interlayer insulating film 160. A contact hole 185 that exposes the output electrode 175 is formed in the protective film 180.

A pixel electrode 190 is formed on the protective film 180. The pixel electrode 190 is physically and electrically connected to the output electrode 175 through the contact hole 185, and may be made of a transparent conductive material such as ITO and IZO or a reflective metal such as aluminum, silver or an alloy thereof.

In addition, a partition wall 360 is formed on the protective film 180. The partition wall 360 surrounds the pixel electrode 190 like a bank to define an opening, and may be made of an organic insulating material or an inorganic insulating material.

An organic light emitting member 370 is formed in an area on the pixel electrode 190 surrounded by the partition walls 360.

As shown in FIG. 4, the organic light emitting member 370 has a multi-layered structure including an emission layer (EML) and auxiliary layers for improving light emitting efficiency of the emission layer. The auxiliary layers include an electron transport layer (ETL) and a hole transport layer (HTL) that balance electrons and holes, and an electron injecting layer (EIL) and an hole injecting layer (HIL) that enhance injection of the electrons and the holes. The auxiliary layers may be omitted.

A common electrode 270 is formed on the partition wall 360 and the organic light emitting member 370. The common electrode 270, which is supplied with a common voltage Vss, is made of a reflective metal such as calcium (Ca), barium (Ba), aluminum (Al), and silver (Ag), or a transparent conductive material such as ITO and IZO.

An opaque pixel electrode 190 and a transparent common electrode 270 are employed in a top emission type of OLED display that displays an image in the upward direction of the display panel 300. A transparent pixel electrode 190 and an opaque common electrode 270 are employed in a bottom emission type of OLED display that displays an image in the downward direction of the display panel 300.

The pixel electrode 190, the organic light emitting member 370, and the common electrode 270 form an organic light emitting element LD shown in FIG. 2. Here, the pixel electrode 190 and the common electrode 270 become the anode and the cathode, respectively. Otherwise, the pixel electrode 190 and the common electrode 270 become the cathode and the anode, respectively. The organic light emitting element LD emits light of one of primary colors depending on a material of the organic light emitting member 370. An example of the primary colors is three primary colors such as red, green, and blue. A desired output color can be obtained by a spatial combination of the primary colors.

Returning to FIG. 1, the scanning driver 400 is connected to the scanning signal lines $G_1$-$G_n$ of the display panel 300 and applies scanning signals $Vg_i$ consisting of a high voltage Von and a low voltage Voff to the scanning signal lines $G_1$-$G_n$.

The emission driver 700 is connected to the emission signal lines $S_1$-$S_n$ and applies emission signals $Vs_i$ consisting of the high voltage Von and the low voltage Voff to the emission signal lines $S_1$-$S_n$.

The high voltage Von turns the switching transistors Qs1, Qs3, and Qs4 on or turns the switching transistors Qs2 and Qs5 off. The low voltage Voff turns the switching transistors Qs1, Qs3, and Qs4 off or turns the switching transistor Qs2 and Qs5 on.

The data driver 500 is connected to the data lines $D_1$-$D_m$ of the display panel 300 and applies the data voltage Vdat representing image signals to the data lines $D_1$-$D_m$.

The signal controller 600 controls operations of the scanning driver 400, the data driver 500, and the emission driver 700.

The scanning driver 400, the data driver 500, and the emission driver 700 may be directly mounted in a form of a plurality of driving integrated circuit (IC) chips on the display panel 300. Alternatively, the scanning driver 400, the data driver 500, and the emission driver 700 may be mounted on a flexible printed circuit (FPC) film (not shown) to be attached in a form of a tape carrier package (TCP) to the display panel 300. Alternatively, the scanning driver 400, the data driver 500, or the emission driver 700 may be integrated on the display panel 300. On the other hand, the data driver 500 and the signal controller 600 may be integrated in a single IC chip (one-chip). In this case, the scanning driver 400 and the emission driver 700 may be optionally integrated in the IC.

Now, the display operations of the OLED display will be described in detail with reference to FIGS. 5-9 together with FIG. 1.

Figure 5:
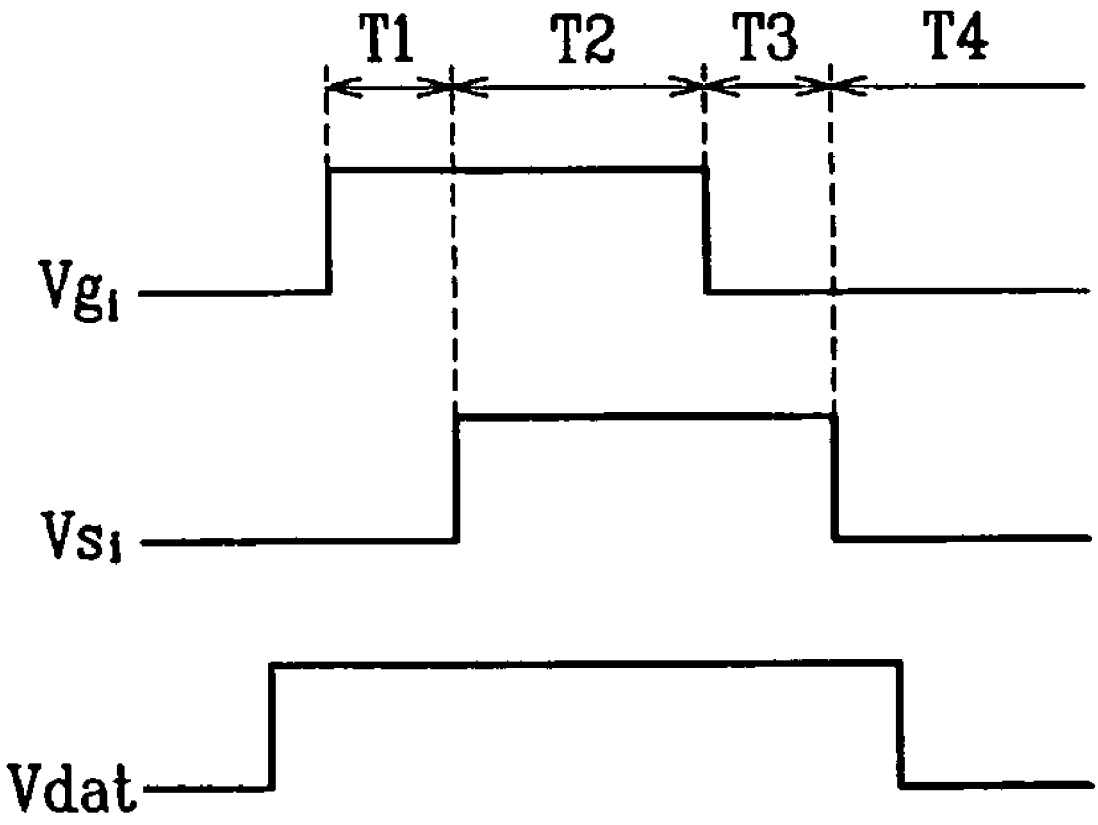
FIG. 5 is a timing diagram showing an example of the driving signals for the OLED display of FIG. 2 according to the embodiment of the present invention.

FIG. 5 is a timing diagram showing an example of a driving signal of the OLED display of FIG. 2 according to the embodiment of the present invention. FIGS. 6-9 are equivalent circuit diagrams of a pixel during periods shown in FIG. 5.

The signal controller 600 receives input image signals R, G, and B and input control signals for controlling the display thereof from an external graphics controller (not shown). As an example of the input control signals, a vertical synchronization signal Vsync, a horizontal synchronization signal Hsync, a main clock signal MCLK, and a data enable signal DE are received. The signal controller 600 processes the image signals R, G, and B according to an operating condition of the display panel assembly 300 and generates scanning control signals CONT1, a processed image signal DAT, data control signals CONT2, and emission control signals CONT3 based on the input control signals and the input image signals R, G, and B. Then, the signal controller 600 transmits the scanning control signals CONT1 to the gate driver 400, the processed image signals DAT and the data control signals CONT2 to the data driver 500, and the emission control signals CONT3 to the emission driver 700.

The scanning control signals CONT1 include an image scanning start signal STV for indicating to the scanning driver 400 the start of the image scanning, at least one clock signal for controlling output timings of the high voltage Von and the low voltage Voff in the scanning signals $Vg_i$, and the like. The scanning control signals CONT1 may further include an output enable signal OE for defining a duration time of the high voltage Von in the scanning signals $Vg_i$.

The data control signals CONT2 include a horizontal synchronization start signal STH for indicating data transmission for one pixel row, a load signal LOAD for commanding the data driver 500 to apply associated data voltages to the data lines $D_1$-$D_m$, a data clock signal HCLK, and the like.

The emission control signals CONT3 include a synchronization signal for start of the emission scanning and at least one clock signal for controlling output timings of the high voltage Von and the low voltage Voff in the emission signals $Vs_i$. The emission control signals CONT3 may further include a signal for defining a duration time of the high voltage Von in the emission signals $Vs_i$.

Now, the following description refers to a specific pixel row of display panel 300, for example, the i-th row.

Responsive to the data control signals CONT2 from the signal controller 600, the data driver 500 receives image data DAT for the pixels Px of the i-th pixel row, and applies data voltages Vdat corresponding to the image data DAT to the data lines $D_1$-$D_m$.

The scanning driver 400 converts the voltage level of the scanning signal $Vg_i$ applied to the scanning signal line $G_1$ into the high voltage Von in response to the scanning control signals CONT1 from the signal controller 600. Accordingly, in the i-th pixel row connected to the scanning signal line $G_i$, the switching transistors Qs1 and Qs3 turn on, and the switching transistors Qs2 turn off. At this time, the emission driver 700 sustains the voltage level of the emission signal $Vs_i$ applied to the emission signal line $S_i$ in the low voltage Voff, the switching transistors Qs4 in the i-th pixel row connected to the emission signal line $S_i$ are sustained in the turn-off state and the switching transistors Qs5 in the i-th pixel row are kept in turn-on state.

Figure 6:
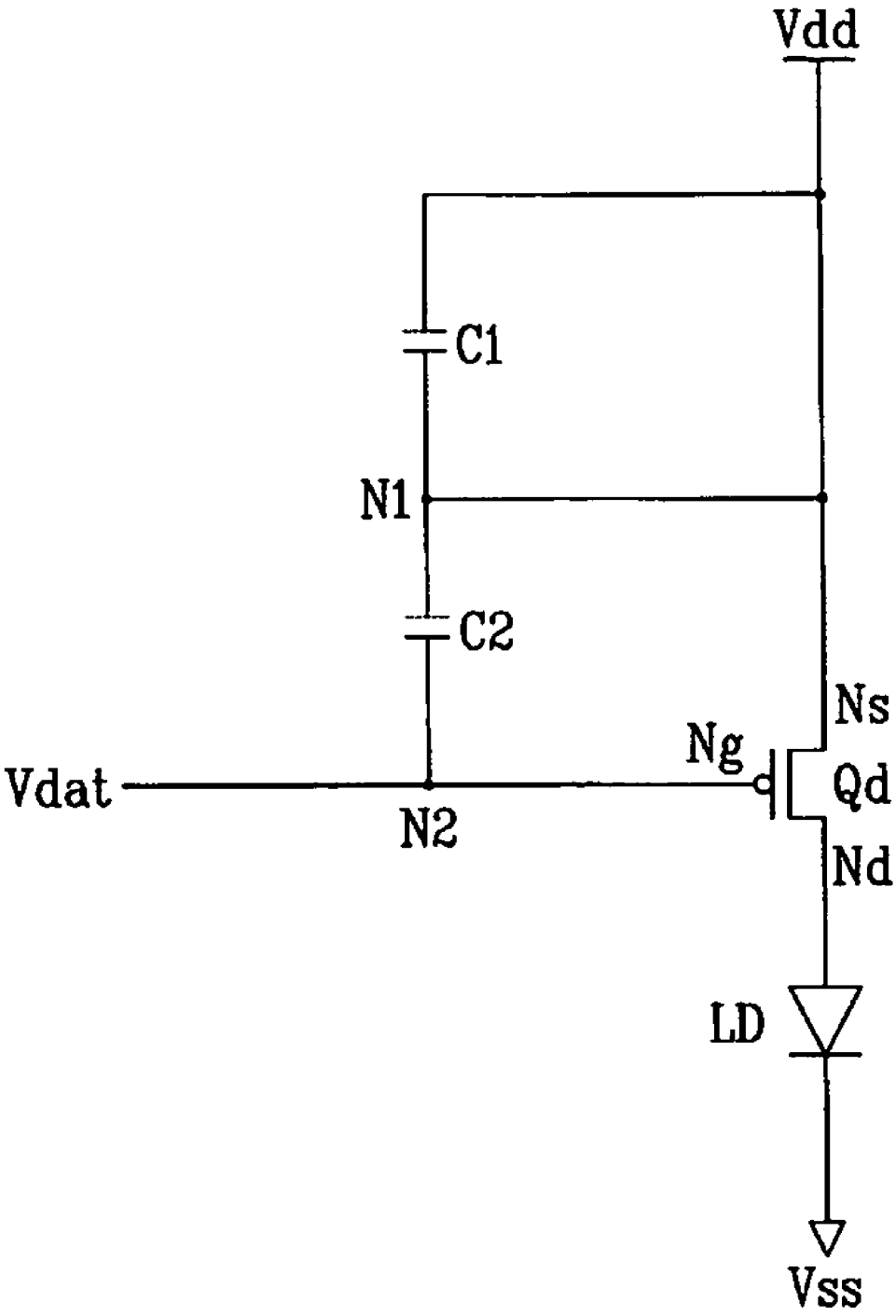
FIGS. 6 to 9 are equivalent circuit diagrams of a pixel during periods shown in FIG. 5.

An equivalent circuit of the pixel Px that is in the above-described step is shown in FIG. 6. A period corresponding to such a step is referred to as a pre-charging period T1 in FIG. 5.

As shown in FIG. 6, the node N1 and the input terminal Ns of the driving transistor Qd are supplied with the driving voltage Vdd, and the node N2, that is, the control terminal Ng of the driving transistor Qd, is supplied with the data voltage Vdat. A voltage difference between the two nodes N1 and N2 is stored in the capacitor C2. At this time, it is preferable that the driving voltage Vdd is much higher than the data voltage Vdat so as to turn the driving transistor Qd on.

Accordingly, the driving transistor Qd turns on to supply a current, which depends on the data voltage Vdat and the threshold voltage Vth, to the organic light emitting element LD through the output terminal Nd. As a result, the organic light emitting diode (OLED) can emit light. However, since the pre-charging period T1 is much shorter than one frame, the light emission from the organic light emitting element LD during the pre-charging period T1 may not be recognized and may hardly influence the target luminance.

Subsequently, the emission driver 700 converts the voltage level of the emission signal $Vs_i$ into the high voltage Von to turn on the switching transistor Qs4 and to turn off the switching transistor Qs5, so that a discharge period T2 can start. Since the scanning signal $Vg_i$ is maintained in the high voltage Von during the discharge period T2, the switching transistors Qs1 and Qs3 are sustained in the turn-on state, and the switching transistor Qs2 is sustained in the turn-off state.

Figure 7:
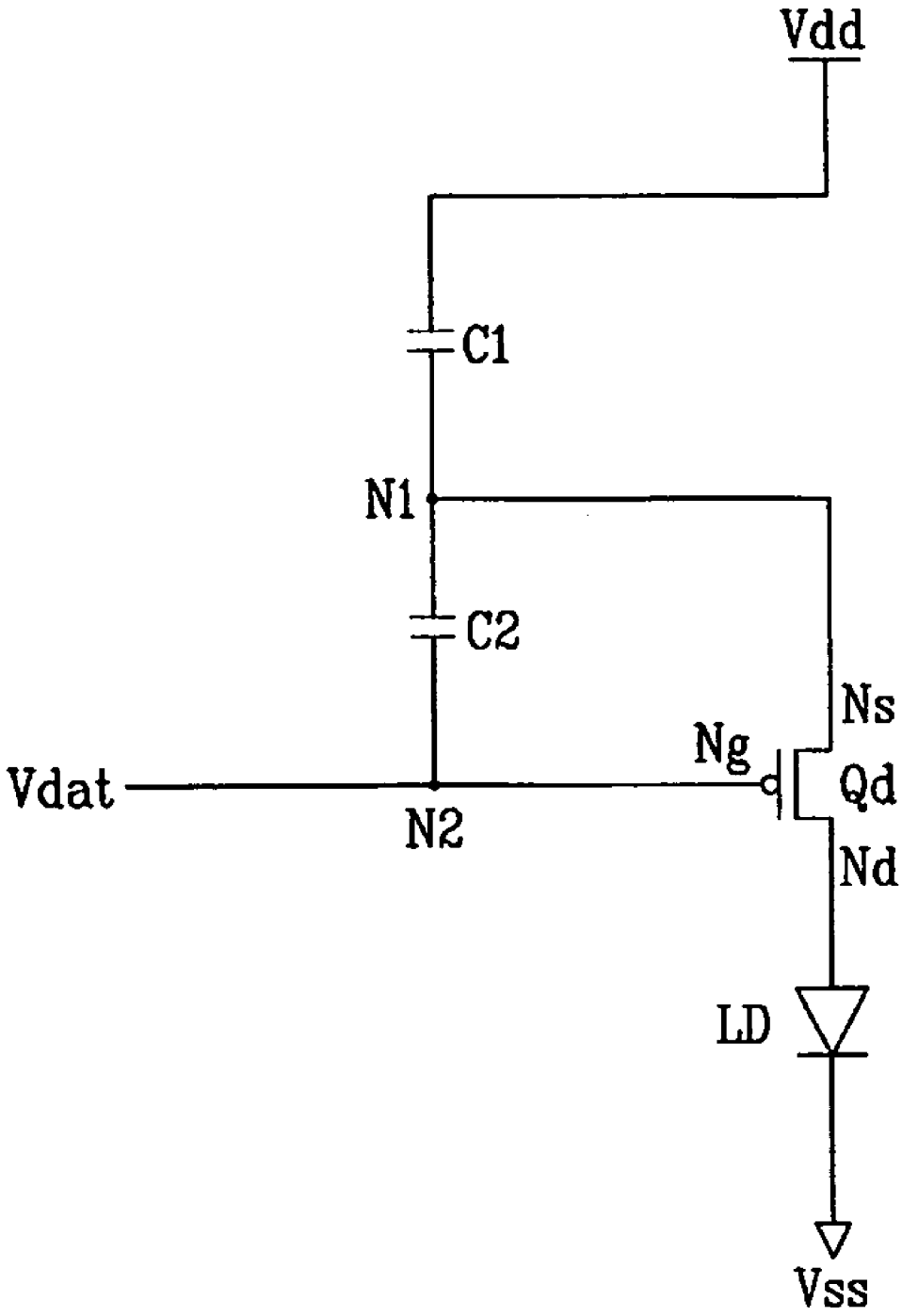

Then, as shown in FIG. 7, the driving voltage Vdd is disconnected from the node N1 and the input terminal Ns of the driving transistor Qd.

In the meantime, since the driving voltage Vdd is larger than the data voltage Vdat, the driving transistor Qd sustains the turn-on state when the discharge period T2 starts. Accordingly, electrical charges stored in the capacitor C2 are discharged through the driving transistor Qd. The discharging proceeds until the voltage difference between the control terminal Ng and the output terminal Ns of the driving transistor Qd is equal to a threshold voltage Vth of the driving transistor Qd. Here, a voltage VN1 of the node N1 converges into a voltage shown in Eq. 1, and the threshold voltage Vth is stored in the capacitor C2.

$$VN1=Vdat-Vth \quad \text{(Eq. 1)}$$

After that, the scanning driver 400 converts the voltage level of the scanning signal $Vg_i$ into the low voltage Voff to turn off the switching transistors Qs1 and Qs3 and to turn on the switching transistor Qs2, so that a data input period T3 can start. Since the emission signal $Vs_i$ is maintained in the high voltage Von during the data input period T3, the switching transistor Qs4 is sustained in the turn-on state, and the switching transistor Qs5 is sustained in the turn-off state.

Figure 8:
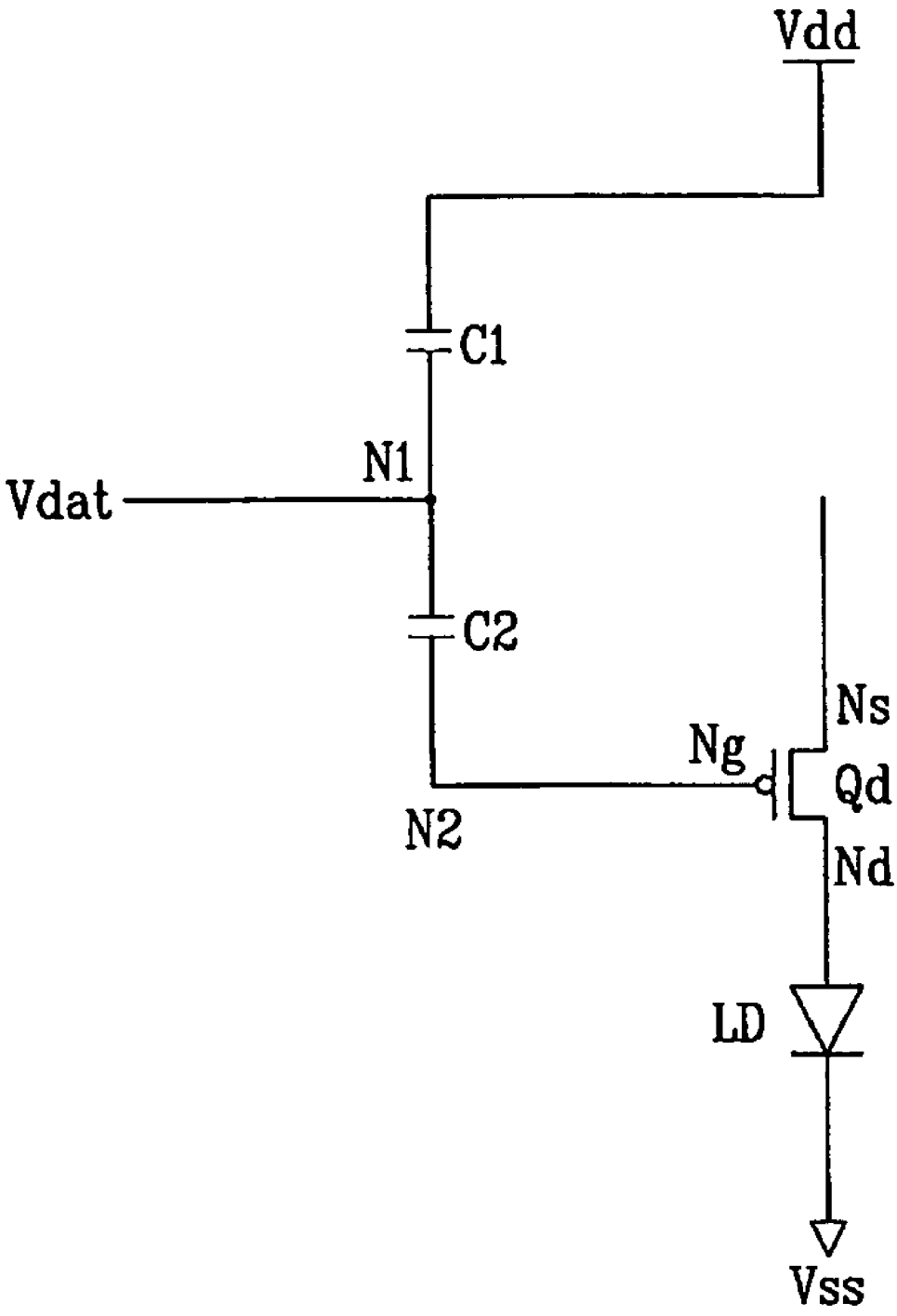

Then, as shown in FIG. 8, the input terminal Ns of the driving transistor Qd is disconnected from the node N1 so as to be left in the floating state, and the node N1 is connected to the data voltage Vdat. Accordingly, the threshold voltage Vth is stored in the capacitor C2. Since no current passes through the capacitor C2, a voltage VN2 of the node N2 can be given as:

$$VN2=Vdat+Vth. \quad \text{(Eq. 2)}$$

In addition, a voltage VC1 is charged in the capacitor C1, which can be represented as:

$$VC1=Vdd-Vdat \quad \text{(Eq. 3)}$$

When a predetermined time elapses after the voltage level of the scanning signal $Vg_i$ is converted into the low voltage Voff, the emission driver 700 converts the voltage level of the emission signal $Vs_i$ into the low voltage Voff to turn off the switching transistor Qs4 and to turn on the switching transistor Qs5, so that a emission period T4 can start. The scanning signal $Vg_i$ is also maintained in the low voltage during the emission period T4.

Figure 9:
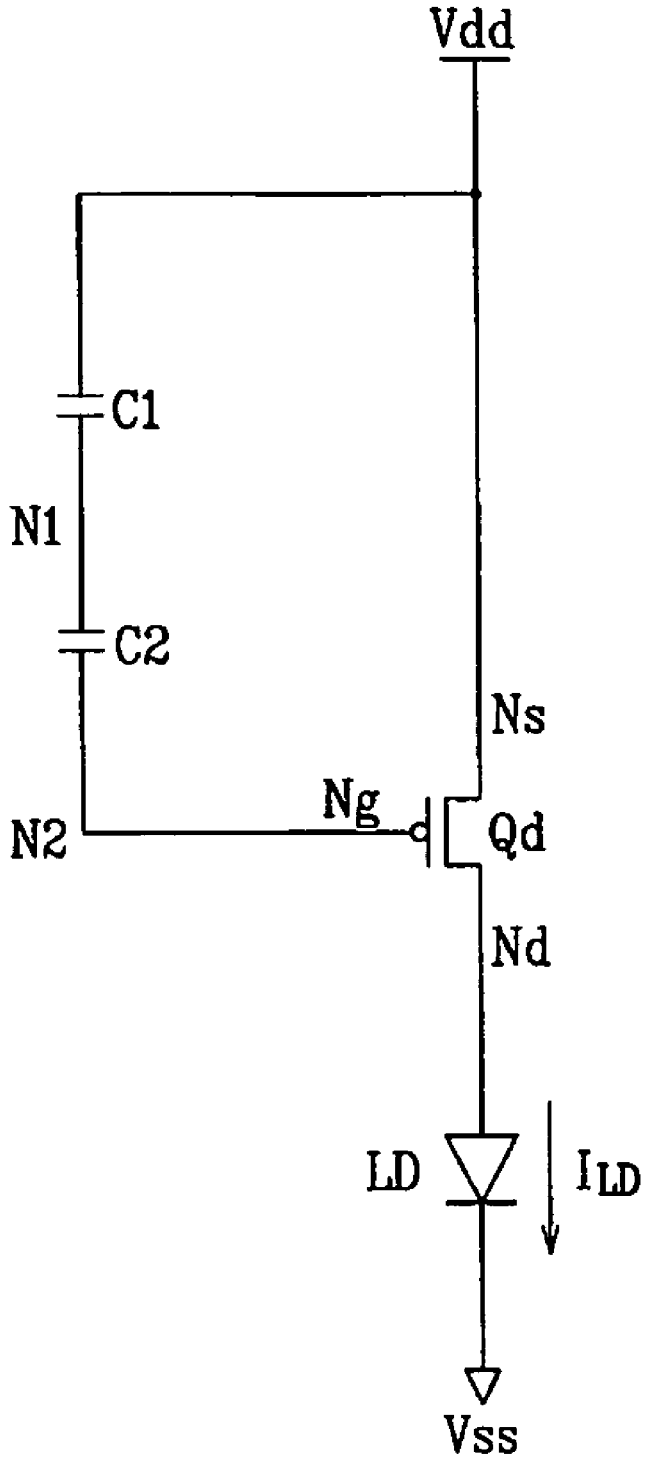

Then, as shown in FIG. 9, the input terminal Ns of the driving transistor Qd is connected to the driving voltage Vdd, and the node N1 is disconnected from the data voltage Vdat. The driving voltage Vdd is set to a sufficiently high value, so that the driving transistor Qd can operate in a saturation region. Accordingly, the driving transistor Qd supplies an output current $I_{LD}$ to the organic light emitting element LD to emit light.

Since substantially no current passes through the control terminal Ng of the driving transistor Qd, the voltage charged in the capacitors C1 and C2 during the data input period T3 is also sustained during the emission period T4.

As a result, the voltage VN2 given by Eq. 2 is also sustained in the node N2. The driving current $I_{LD}$ flowing through the OLED LD by the driving transistor Qd during the emission period T4 is determined irrespective of the threshold voltage Vth of the driving transistor Qd and the threshold voltage Vth of the OLED LD is given as:

$$\begin{aligned} I_{LD} &= 1/2\times K\times(Vgs-Vth)^2 \quad \text{(Eq. 4)} \\ &= 1/2\times K\times(VN2-Vdd-Vth)^2 \\ &= 1/2\times K\times(Vdat+Vth-Vdd-Vth)^2 \\ &= 1/2\times K\times(Vdat-Vdd)^2. \end{aligned}$$

Here, K is a constant according to characteristics of a TFT, that is, K=μCiW/L. Here, μ denotes a field effect mobility; Ci denotes a capacitance of an insulating layer; W denotes a channel width of the driving transistor Qd; and L denotes a channel length of the driving transistor Qd.

As given by Eq. 4, the output current $I_{LD}$ during the emission period T4 is determined by only the data voltage Vdat and the driving voltage Vdd. Since the output current $I_{LD}$ is not influenced by the threshold voltage Vth of the driving transistor Qd, a uniform image can be displayed irrespective of a variation in the threshold voltage Vth of the driving transistor Qd.

The emission period T4 proceeds until the pre-charging period T1 for the pixels Px in the i-th pixel row of the next frame starts. The aforementioned operations of the periods T1-T4 repeat for the pixels Px in the next pixel row. However, for example, the pre-charging period T1 for the (i+1) pixel row starts after the end of the data input period T3 for the i-th pixel row. In this manner, the periods T1-T4 sequentially repeat for all the scanning signal lines $G_1$-$G_n$ and the emission signal lines $S_1$-$S_n$, so that an image associated with all the pixels Px can be displayed.

The lengths of the periods T1-T4 may be adjusted as needed. The data driver 500 may apply the data voltage Vdat to the data lines $D_1$-$D_m$ during the pre-charging period T1. However, the data voltage Vdat may not change during the discharge period T2.

Meanwhile, in a conventional OLED display, in order to initialize the driving transistor, the control terminal and the output terminal are diode-connected. For this reason, a switching transistor is provided between the control terminal and the output terminal. However, since a parasitic capacitance between the gate and source electrodes of the switching transistor greatly varies according to a structure of the TFT, the diode-connected driving transistor may not be initialized. As a result, the threshold voltage of the driving transistor may not be compensated for, so that a uniform image cannot be displayed.

However, in the OLED display according to the embodiment of the present invention, the control terminal Ng and the output terminal Nd of the driving transistor Qd are not diode-connected. However, the driving transistor Qd is initialized by directly applying the data voltage Vdat to the control terminal Ng and by applying the driving voltage Vdd and the input terminal Ns during the pre-charging period T1, so that the variation in threshold voltage of the driving transistor Qd can be stably compensated for.

Now, a result of simulation of the output current depending on a variation in threshold voltage of the driving transistor in an OLED display according to an embodiment of the present invention will be described with reference to FIG. 10.

Figure 10:
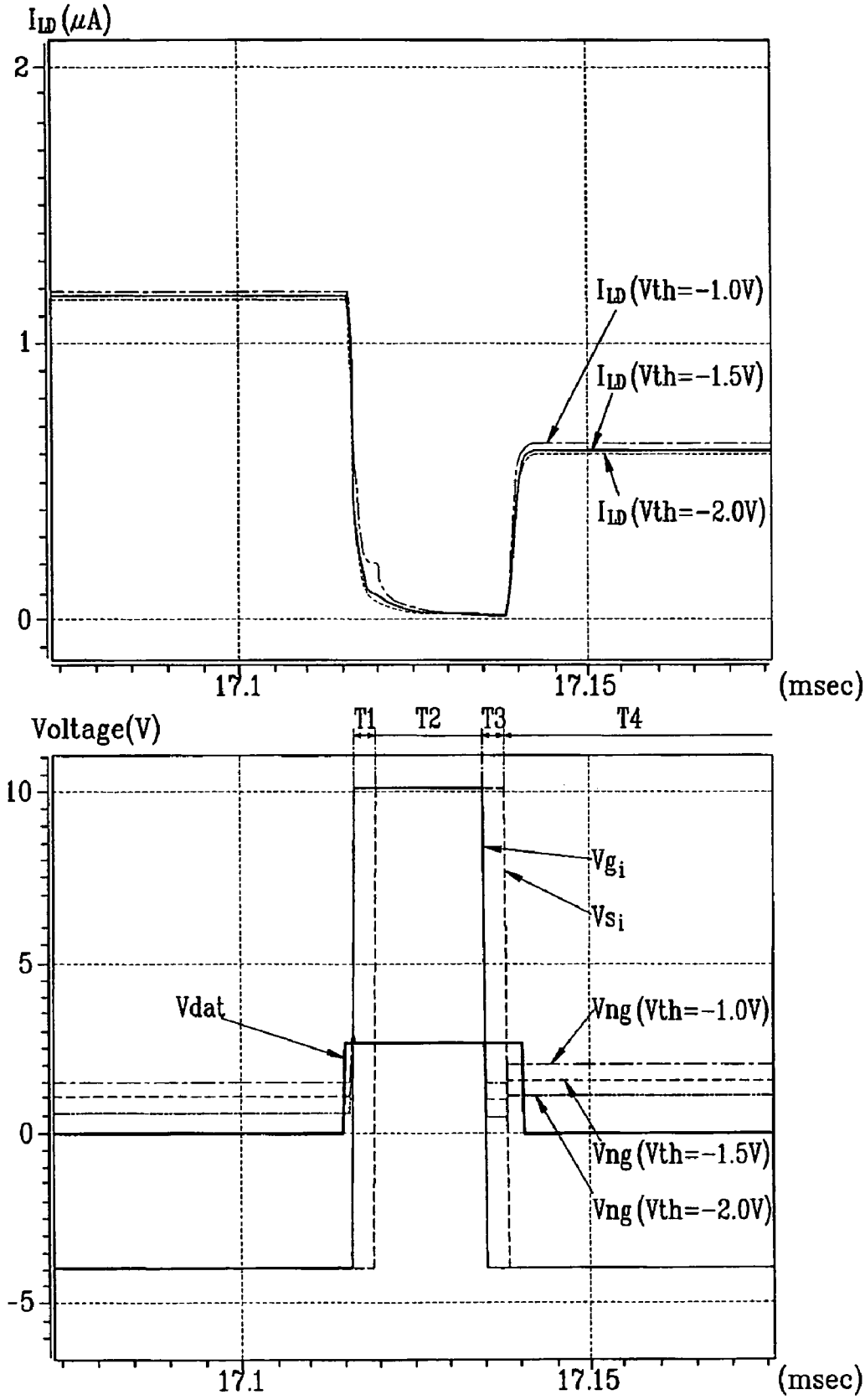
FIG. 10 is a waveform view showing a control terminal voltage and an output current in response to a driving signal and a threshold voltage of a driving transistor of the OLED display according to the embodiment of the present invention.

FIG. 10 shows waveforms of the control terminal voltage and the output current in response to the driving signal and the threshold voltage of the driving transistor of the OLED display according to the embodiment of the present invention.

FIG. 10 shows the control terminal voltage Vng and the output current $I_{LD}$ of the driving transistor Qd in cases where the threshold voltages Vth of the driving transistor were −1.0V, −1.5V and −2.0V. The simulation was performed by using SPICE (simulation program with integrated circuit emphasis). As conditions for the simulation, the high voltage Von, the low voltage Voff, and the data voltage Vdat were set to 10V, −4V, and about 2.5V, respectively. Under the conditions for the simulation, the voltages of the control terminal Ng of the driving transistor Qd were varied by a voltage step of about 0.5V as the threshold voltage varies by a voltage step of about 0.5V. As a result, it can be seen that the driving currents $I_{LD}$ of the organic light emitting element LD for the cases are substantially equal to each other.

The simulation shows that the OLED display according to the embodiment of the present invention can compensate for the variation of threshold voltage Vth of the driving transistor Qd.

Now, an OLED display according to another embodiment of the present invention will be described with reference to FIGS. 11 and 12.

Figure 11:
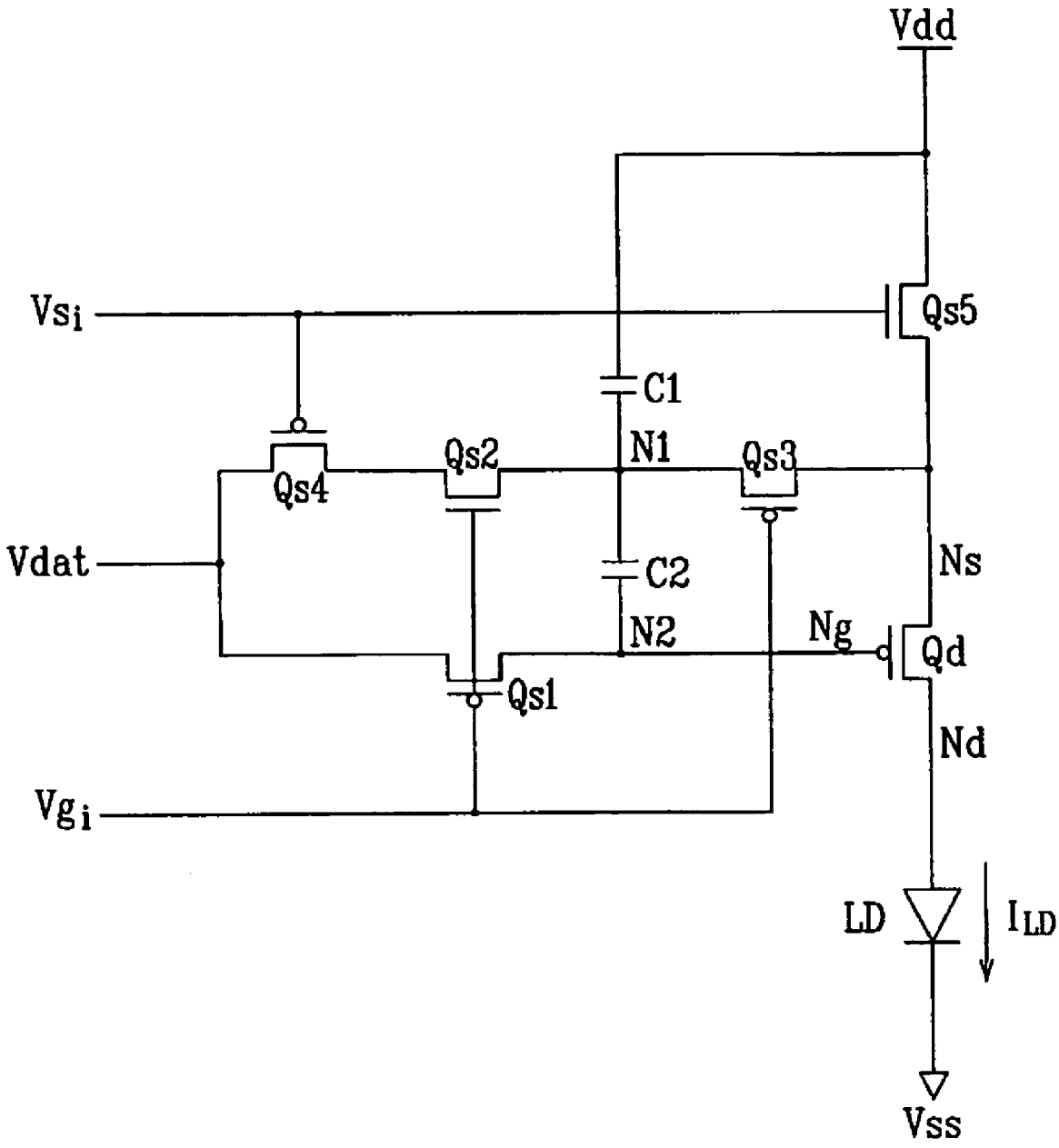
FIG. 11 is a block diagram showing an OLED display according to another embodiment of the present invention.
Figure 12:
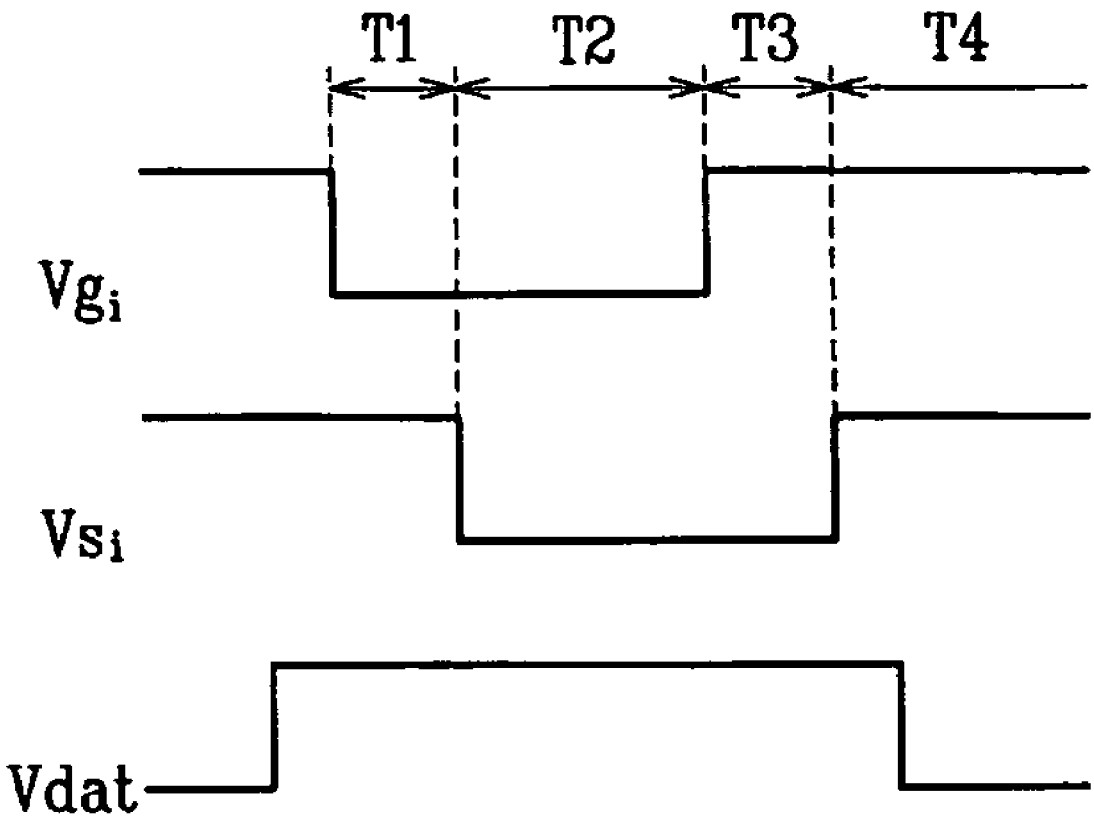
FIG. 12 is a timing diagram showing an example of driving signals for the OLED display of FIG. 11 according to an embodiment of the present invention.

FIG. 11 is a block diagram showing the OLED display according to another embodiment of the present invention, and FIG. 12 is a timing diagram showing an example of a driving signal for the OLED display of FIG. 11 according to the embodiment of the present invention.

As shown in FIG. 11, each of the pixels of the OLED display according to the embodiment of the present invention includes an organic light emitting element LD, a driving transistor Qd, two capacitors C1 and C2, and five switching transistors Qs1-Qs5.

The channel types of the switching transistors Qs1-Qs5 of the pixel in FIG. 11 are opposite to the channel types of the switching transistors Qs1-Qs5 of the pixel shown in FIG. 2. That is, in the present embodiment, the switching transistors Qs1, Qs3, and Qs4 are p-channel TFTs, and the switching transistors Qs2 and Qs5 are n-channel TFTs. Except for the channel types, the two pixels are substantially the same, and thus a detailed description of the pixel shown in FIG. 11 is omitted.

As the channel types of the switching transistors Qs1-Qs5 change, the voltages for turning the switching transistors Qs1-Qs5 on and off also change accordingly. As shown in FIG. 12, the voltage levels of the scanning signals $Vg_i$ and the emission signals $Vs_i$ are opposite to those shown in FIG. 5. In the present embodiment, the display operation during the periods T1-T4 are the same as those of the aforementioned embodiment, and thus a detailed description thereof is omitted.

Now, an OLED display according to another embodiment of the present invention will be described with reference to FIGS. 13 and 14.

Figure 13:
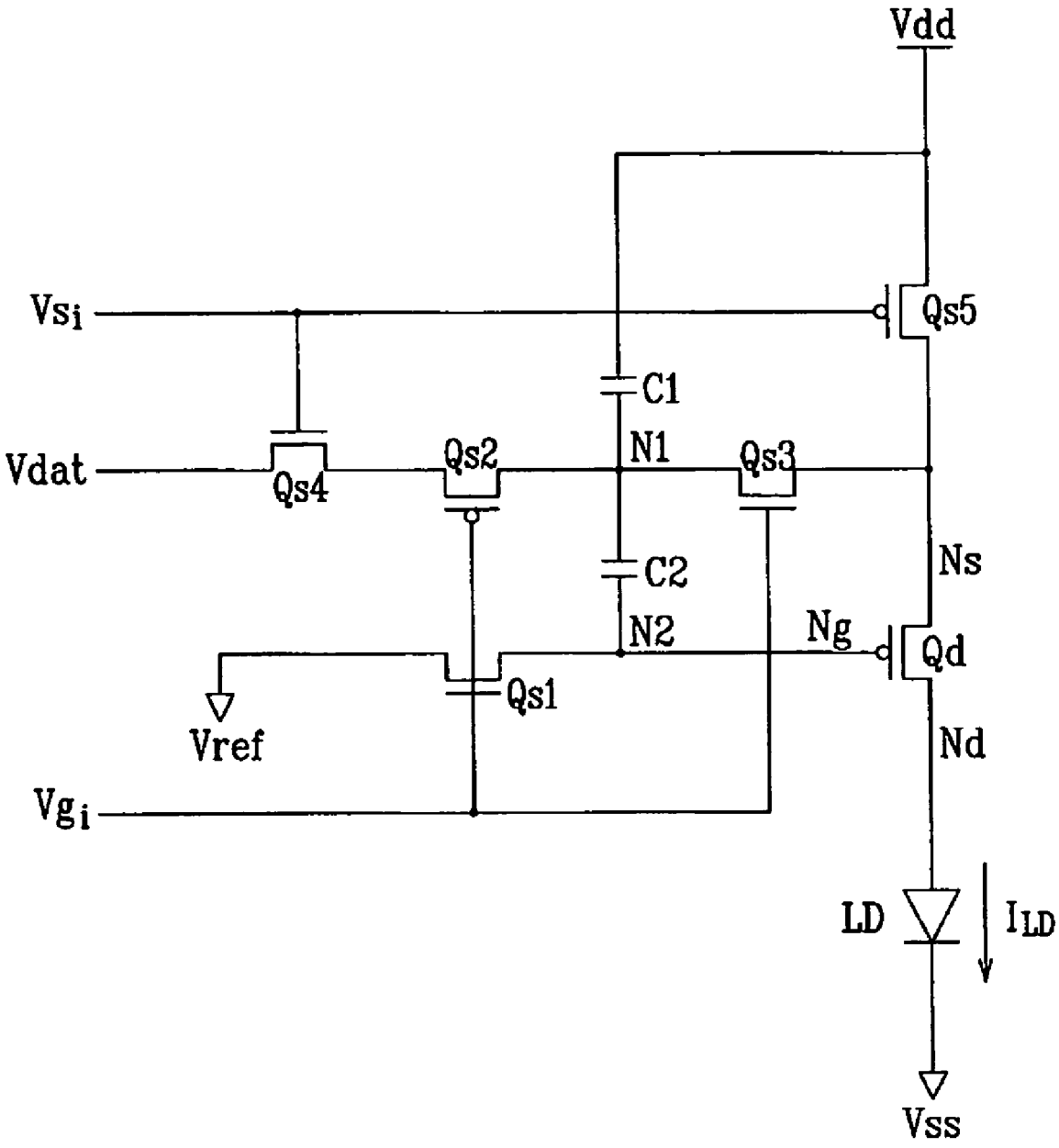
FIGS. 13 and 14 are equivalent circuit diagrams of a pixel in the OLED display according to alternate embodiments of the present invention.
Figure 14:
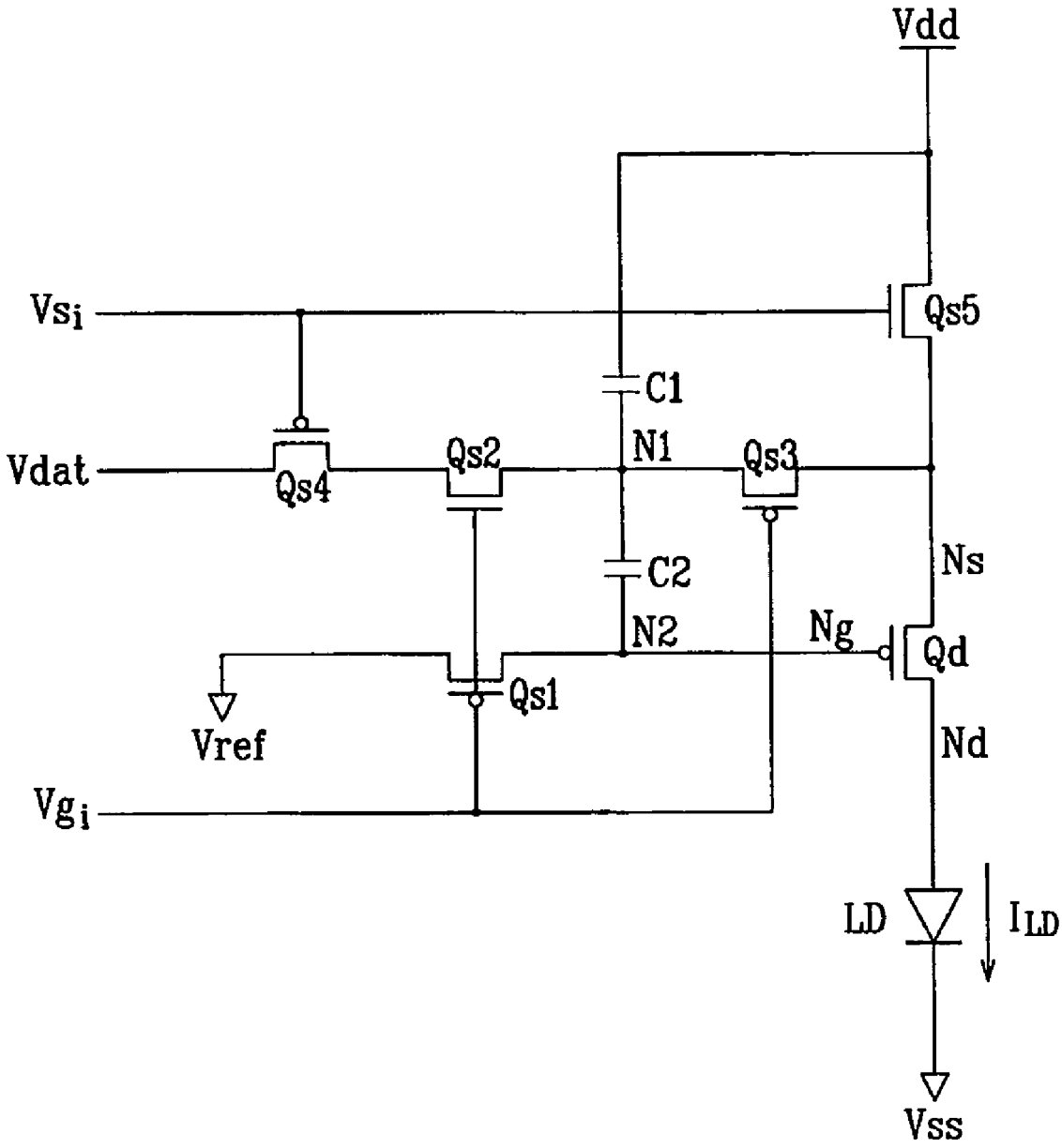

FIGS. 13 and 14 are equivalent circuit diagrams of a pixel in the OLED display according to the embodiment of the present invention.

The pixel shown in FIG. 13 is substantially the same as the pixel shown in FIG. 2 except that the switching transistor Qs1 is connected between a reference voltage Vref and the control terminal Ng of the driving transistor Qd. Accordingly, during the pre-charging period T1 and the discharge period T2, the switching transistor Qs1 turns on, and the reference voltage Vref, which is constant, is applied to the control terminal Ng of the driving transistor Qd. As thus constructed, since the voltage applied to the control terminal Ng of the driving transistor Qd is kept at the reference voltage Vref and not varied, it is possible to better compensate for a variation in threshold voltage Vth of the driving transistor Qd. In addition, since the data voltage Vdat may be applied during the discharge period T2, it is possible to secure a margin of driving timing of the data voltage Vdat.

In addition, in the pixel shown in FIG. 14, the switching transistor Qs1 is connected between a reference voltage Vref and the control terminal Ng of the driving transistor Qd. Except that the channel types of the switching transistors Qs1-Qs5 of the pixel shown in FIG. 14 are opposite to the channel types of the switching transistors Qs1-Qs5 of the pixel shown in FIG. 13, other components of the two pixels are substantially the same, and thus a detailed description thereof is omitted.

Although the capacitor C1 of the OLED display according to the embodiment is connected between the driving voltage Vdd and the node N1, another voltage instead of the driving voltage Vdd may be connected to the capacitor C1.

According to the present invention, five switching transistors, a single driving transistor, two capacitors, and a single organic light emitting element are provided to a single pixel so as to store a threshold voltage of the driving transistor in the capacitor, so that it is possible to display a uniform image by compensating for a variation in threshold voltage of the driving transistor.

Although the exemplary embodiments and the modified examples of the present invention have been described, the present invention is not limited to the embodiments and examples, but may be modified in various forms without departing from the scope of the appended claims, the detailed description, and the accompanying drawings of the present invention. Therefore, it is natural that such modifications fall within to the scope of the present invention.

What is claimed is:

1. A display device comprising a plurality of pixels, wherein each of the pixels comprises:

a light emitting element;

a first capacitor connected between a first node and a second node;

a driving transistor having an input terminal, an output terminal directly coupled to the light emitting element, and a control terminal connected to the second node, the driving transistor supplying a driving current to the light emitting element to emit light;

a first switching unit supplying a first reference voltage to the control terminal of the driving transistor according to a first scanning signal and connecting the first node to a data voltage or the driving transistor; and a second switching unit supplying a driving voltage to the input terminal of the driving transistor according to a second scanning signal and connecting the first node to the data voltage.

2. The display device of claim 1, wherein the first switching unit comprises a first switching transistor connecting the data voltage to the control terminal of the driving transistor according to the first scanning signal.

3. The display device of claim 2, wherein the first switching unit further comprises:

a second transistor connecting the data voltage to the first node according to the first scanning signal; and a third switching transistor connecting the first node to the input terminal of the driving transistor according to the first scanning signal.

4. The display device of claim 3, wherein the second switching unit comprises:

a fourth transistor connecting the data voltage to the first node according to the second scanning signal; and a fifth switching transistor connecting the driving voltage to the input terminal of the driving transistor according to the second scanning signal.

5. The display device of claim 4, wherein the first scanning signal substantially simultaneously turns the first and third switching transistors on and the second switching transistor off, or turns the first and third switching transistors off and the second switching transistor on.

6. The display device of claim 5, wherein the second scanning signal substantially simultaneously turns the fourth switching transistor on and the fifth switching transistor off, or turns the fourth switching transistor off and the fifth switching transistor on.

7. The display device of claim 6, wherein the first to fifth switching transistors and the driving transistor comprise polysilicon thin film transistors.

8. The display device of claim 7, wherein the driving transistor comprises a p-channel thin film transistor.

9. The display device of claim 8, wherein a channel type of the first, third, and fourth switching transistors is different from that of the second and fifth switching transistors.

10. The display device of claim 1, wherein the pixel further comprises a second capacitor connected between the first node and a second reference voltage.

11. The display device of claim 10, wherein the second reference voltage is equal to the driving voltage.

12. The display device of claim 1, wherein the first reference voltage is equal to the data voltage.

13. The display device of claim 1, wherein the first reference voltage is a constant voltage.

14. A display device comprising:

a light emitting element;

a first capacitor connected between a first node and a second node;

a driving transistor having an input terminal, an output terminal directly connected to the light emitting element, and a control terminal connected to the second node;

a first switching transistor connecting a first reference data voltage to the control terminal of the driving transistor according to a first scanning signal and connected between the first reference voltage and the second node;

a second switching transistor operating in response to the first scanning signal and connected between a data voltage and the first node;

a third switching transistor operating in response to the first scanning signal and connected between the first node and the input terminal of the driving transistor;

a fourth switching transistor operating in response to a second scanning signal and connected between the data voltage and the first node; and a fifth switching transistor operating in response to the second scanning signal and connected between a driving voltage and the input terminal of the driving transistor.

15. The display device of claim 14, wherein first, second, third, and fourth periods are sequentially provided, wherein during the first period, the first, third, and fifth switching transistors are turned on and the second and fourth switching transistors are turned off, wherein during the second period, the first and third switching transistors are turned on, and the second and fifth switching transistors are turned off, wherein during the third period, the second and fourth switching transistors are turned on, and the first, third, and fifth switching transistors are turned off, and wherein during the fourth period, the fifth switching transistor is turned on, and the first, third, and fourth switching transistors are turned off.

16. The display device of claim 14, further comprising a second capacitor connected between the first node and a second reference voltage.

17. The display device of claim 16, wherein the second reference voltage is equal to the driving voltage.

18. The display device of claim 14, wherein the first reference voltage is equal to the data voltage.

19. The method of claim 14, wherein the first reference voltage is a constant voltage.

20. A method of driving a display device comprising a light emitting element, a first capacitor connected between a first node and a second node, a second capacitor connected to the first node, and a driving transistor having an input terminal, an output terminal directly connected to the light emitting element, and a control terminal connected to the second node, the method comprising:

applying a first reference voltage to the second node;

applying a driving voltage to the first node;

discharging a voltage stored in the first capacitor;

applying a data voltage to the first node; and applying the driving voltage to the input terminal of the driving transistor.

21. The method of claim 20, wherein applying the driving voltage to the first node comprises:

connecting the first node to the input terminal of the driving transistor.

22. The method of claim 20, wherein the discharging comprises:

disconnecting the first node and the input terminal of the driving transistor from the driving voltage.

23. The method of claim 20, wherein applying the data voltage to the first node comprises:

floating the input terminal of the driving transistor.

24. The method of claim 23, wherein the floating comprises:

disconnecting the input terminal of the driving transistor from the first node.

25. The method of claim 20, wherein applying the data voltage to the first node comprises:

disconnecting the second node from the first reference voltage.

26. The method of claim 20, further comprising:

applying the driving voltage to the second capacitor.

* * * * *